US009842529B2

(12) United States Patent
Jeong et al.

(10) Patent No.: US 9,842,529 B2
(45) Date of Patent: Dec. 12, 2017

(54) DISPLAY DEVICE HAVING IMPROVED PIXEL PRE-CHARGING CAPABILITY AND DRIVING METHOD THEREOF

(71) Applicant: Samsung Display Co., Ltd., Yongin, Gyeonggi-Do (KR)

(72) Inventors: Ji-Woong Jeong, Yongin-si (KR); Jung-Taek Kim, Seoul (KR); Eun Ho Lee, Suwon-si (KR); Cheol Woo Park, Suwon-si (KR)

(73) Assignee: Samsung Display Co., Ltd. (KR)

( * ) Notice: Subject to any disclaimer, the term of this patent is extended or adjusted under 35 U.S.C. 154(b) by 156 days.

(21) Appl. No.: 14/340,406

(22) Filed: Jul. 24, 2014

(65) Prior Publication Data

US 2015/0035739 A1 Feb. 5, 2015

(30) Foreign Application Priority Data

Aug. 5, 2013 (KR) ..... 10-2013-0092673

(51) Int. Cl.
*G09G 3/36* (2006.01)
*G09G 3/20* (2006.01)

(52) U.S. Cl.
CPC ..... *G09G 3/2003* (2013.01); *G09G 3/3648* (2013.01); *G09G 2310/0251* (2013.01); *G09G 2310/06* (2013.01); *G09G 2330/021* (2013.01)

(58) Field of Classification Search
CPC ..... G09G 3/36; G09G 3/2003; G09G 3/3614; G09G 3/3648; G09G 3/3674; G09G 2310/0248; G09G 2310/0251
USPC ..... 345/87–104
See application file for complete search history.

(56) References Cited

U.S. PATENT DOCUMENTS

| | | | | |
|---|---|---|---|---|
| 7,304,630 | B2 | 12/2007 | Kobayashi et al. | |
| 7,471,269 | B2 | 12/2008 | Ushigusa et al. | |
| 7,486,264 | B2 | 2/2009 | Taguchi | |
| 7,808,494 | B2 | 10/2010 | Lee et al. | |
| 2005/0231455 | A1* | 10/2005 | Moon | G09G 3/3648 345/89 |
| 2006/0050563 | A1* | 3/2006 | Lee | G09G 3/3648 365/185.22 |
| 2007/0046609 | A1 | 3/2007 | Lee | |

(Continued)

FOREIGN PATENT DOCUMENTS

| | | | |
|---|---|---|---|
| KR | 10-2008-0096907 | A | 11/2008 |
| KR | 10-2008-0111848 | A | 12/2008 |

(Continued)

*Primary Examiner* — Alexander Eisen
*Assistant Examiner* — Nelson Lam
(74) *Attorney, Agent, or Firm* — Innovation Counsel LLP

(57) ABSTRACT

A gate-on voltage applied to a third gate line connected to the current stage pixel is configured to be applied during any one or more of a first pre-charge period, a second pre-charge period, and a main-charge period. Data voltages are applied, in order, to a before-previous stage pixel, a previous stage pixel, and a current stage pixel, and the signal controller is configured to control the gate driver to selectively apply the gate-on voltage to the gate line connected to the current stage pixel during at least one of the first pre-charge period while the before-previous stage pixel is being charged and the second pre-charge period while the previous stage pixel is charged, so as to at least partially pre-charge the current stage pixel.

12 Claims, 13 Drawing Sheets

(56) References Cited

U.S. PATENT DOCUMENTS

| | | | | |
|---|---|---|---|---|
| 2008/0024418 | A1* | 1/2008 | Kim | G09G 3/3648 345/98 |
| 2008/0191987 | A1* | 8/2008 | Lee | G09G 3/3614 345/92 |
| 2010/0149157 | A1* | 6/2010 | Shih | G02F 1/13624 345/211 |
| 2010/0315403 | A1* | 12/2010 | Kaneyoshi | G09G 3/3614 345/211 |
| 2013/0135360 | A1* | 5/2013 | Hwang | G09G 3/3607 345/690 |
| 2015/0187292 | A1* | 7/2015 | Kim | G09G 3/3614 345/88 |

FOREIGN PATENT DOCUMENTS

| | | | |
|---|---|---|---|
| KR | 10-2009-0041249 | A | 4/2009 |
| KR | 10-2011-0076642 | A | 7/2011 |
| KR | 10-1211750 | B1 | 12/2012 |
| KR | 10-1226272 | B1 | 1/2013 |

* cited by examiner

DISPLAY DEVICE HAVING IMPROVED PIXEL PRE-CHARGING CAPABILITY AND DRIVING METHOD THEREOF

CROSS-REFERENCE TO RELATED APPLICATION

This application claims priority to, and the benefit of, Korean Patent Application No. 10-2013-0092673 filed in the Korean Intellectual Property Office on Aug. 5, 2013, the entire contents of which are incorporated herein by reference.

BACKGROUND (a) Technical Field

Embodiments of the present invention relate generally to flat panel displays. More specifically, embodiments of the present invention relate to a display device and a driving method thereof.

(b) Description of the Related Art

A general display device includes two display panels including a pixel electrode and a common electrode, and a liquid crystal layer having dielectric anisotropy interposed therebetween. The pixel electrodes are arranged in a matrix form and connected to switching elements, such as thin film transistors (TFTs), to sequentially receive data voltages for every row. The common electrodes are formed over the entire surface of the display panel to receive common voltages. The pixel electrode, the common electrode, and the liquid crystal display therebetween form a liquid crystal capacitor when viewed from a circuit, and the liquid crystal capacitor becomes a basic unit which forms a pixel together with the switching element connected thereto.

In such a display device, an electric field is generated in the liquid crystal layer by applying voltages to the two electrodes, and transmittance of light passing through the liquid crystal layer is controlled by controlling an intensity of the electric field, thereby producing a desired image. In this case, in order to prevent a degradation phenomenon generated by applying the electric field in one direction to the liquid crystal layer for a long time, a voltage polarity of a data signal for the common voltage is inverted for each frame, for each row, or for each pixel.

Liquid crystal molecules may be aligned to some degree in advance by performing pre-charging for a predetermined time before a normal data voltage is applied to the liquid crystal capacitor. In this case, even though normal data voltages having the same magnitude are applied to a plurality of capacitors existing in the same pixel row, when pre-charging amounts are different from each other, a difference in luminance occurs due to different charging amounts charged in the liquid crystal capacitor, and as a result, an image quality defect in which a flicker is recognized occurs.

The above information disclosed in this Background section is only for enhancement of understanding of the background of the invention and therefore it may contain information that does not form the prior art that is already known in this country to a person of ordinary skill in the art.

SUMMARY

Embodiments of the present invention have been made in an effort to provide a display device and a driving method thereof having advantages of preventing an image quality defect due to an insufficient charging time of a liquid crystal capacitor. Further, embodiments of the present invention have been made in an effort to provide a display device and a driving method thereof having advantages of improving image quality of the display device occurring by pre-charging. Further, embodiments of the present invention have been made in an effort to provide a display device and a driving method thereof having advantages of reducing power consumption of the display device.

An exemplary embodiment of the present invention provides a display device, including: a current stage pixel, a previous stage pixel, and a before-previous stage pixel each including a liquid crystal layer; a data line connected to the before-previous stage pixel, the previous stage pixel, and the current stage pixel to transfer data voltages; a first gate line, a second gate line, and a third gate line connected to the before-previous stage pixel, the previous stage pixel, and the current stage pixel, respectively, so as to transfer gate-on voltages; a gate driver configured to apply the gate-on voltages to the first gate line, the second gate line, and the third gate line, respectively; a data driver configured to apply the data voltages to the data line; and a signal controller configured to control operations of the gate driver and the data driver. The gate-on voltage applied to the third gate line connected to the current stage pixel is configured to be applied during any one or more of a first pre-charge period, a second pre-charge period, and a main-charge period; the data voltages are configured to be applied, in order, to the before-previous stage pixel, the previous stage pixel, and the current stage pixel; and the signal controller is configured to control the gate driver to selectively apply the gate-on voltage to the gate line connected to the current stage pixel during at least one of the first pre-charge period while the before-previous stage pixel is being charged and the second pre-charge period while the previous stage pixel is charged, so as to at least partially pre-charge the current stage pixel.

In order to apply a first gray to the current stage pixel, the signal controller may be further configured to control the gate driver to apply the gate-on voltage to the gate line connected to the current stage pixel during the first pre-charge period, while a second gray is applied to the previous stage pixel.

The signal controller may be further configured to control the gate driver to apply a gate-off voltage to the gate line connected to the current stage pixel during the second pre-charge period.

The first gray may be a maximum gray, and the second gray may be a minimum gray.

In order to apply a first gray to the current stage pixel, the signal controller may be further configured to control the gate driver to apply the gate-on voltage to the gate line connected to the current stage pixel during the second pre-charge period, while the first gray is applied to the previous stage pixel.

The signal controller may be further configured to control the gate driver to apply the gate-on voltage to the gate line connected to the current stage pixel during the first pre-charge period, while the second gray is applied to the before-previous stage pixel.

The signal controller may be further configured to control the gate driver to apply a gate-off voltage to the gate line connected to the current stage pixel during the first pre-charge period, while the first gray is applied to the before-previous stage pixel.

In order to apply a second gray to the current stage pixel, the signal controller may be further configured to control the gate driver so that the gate-on voltage is not applied to the gate line connected to the current stage pixel during either the second pre-charge period or the first pre-charge period.

The signal controller may be further configured to control the gate driver so that the gate-on voltage is not applied to the gate line connected to the current stage pixel while the first gray is applied to either the before-previous stage pixel or the previous stage pixel, during either the second pre-charge period or the first pre-charge period.

The signal controller may be further configured to control the gate driver to apply the gate-off voltage to the gate line connected to the current stage pixel during the second pre-charge period and the first pre-charge period.

Another exemplary embodiment of the present invention provides a method of driving a display device, including: sequentially applying data voltages to a before-previous stage pixel, a previous stage pixel, and a current stage pixel; for charging of the current stage pixel, determining, by a signal controller, whether a sufficient time to reach a target voltage exists; and controlling the gate driver, by the signal controller, to selectively apply a gate-on voltage to a gate line connected to the current stage pixel during a first pre-charge period during which the before-previous stage pixel is charged, or during a second pre-charge period during which the previous stage pixel is charged, based on the determining.

According to exemplary embodiments of the present invention, when a current pixel is charged up to a target voltage, it is possible to reduce unnecessary power consumption by selectively performing pre-charging 0 to 2 times, and to improve display quality by charging a voltage applied to the pixel up to the target voltage.

DETAILED DESCRIPTION OF THE EMBODIMENTS

Figure 1:
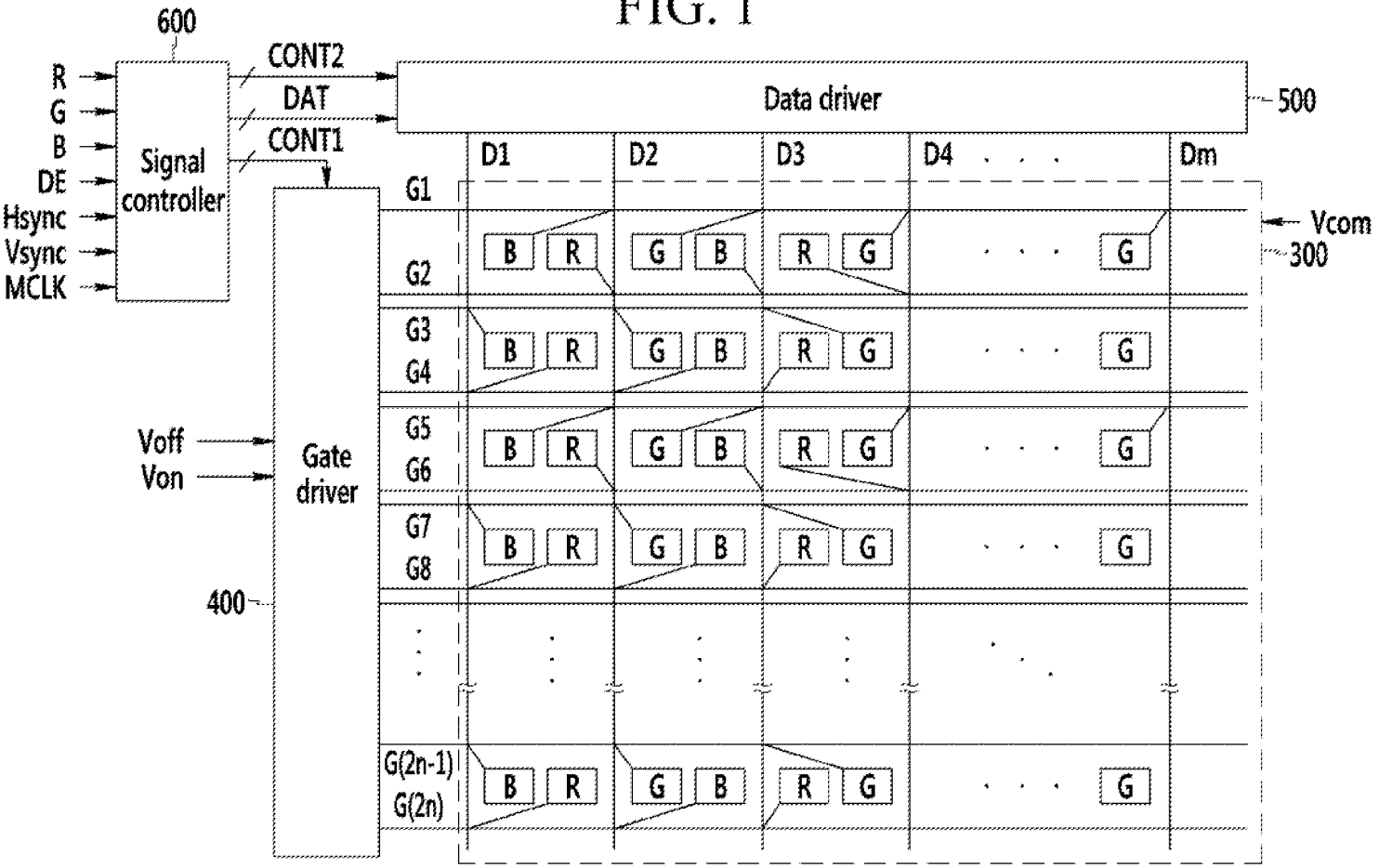
FIG. 1 is a block diagram of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings are not to scale.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Hereinafter, a display device according to an exemplary embodiment of the present invention will be described in detail with reference to the accompanying drawings.

Figure 2:
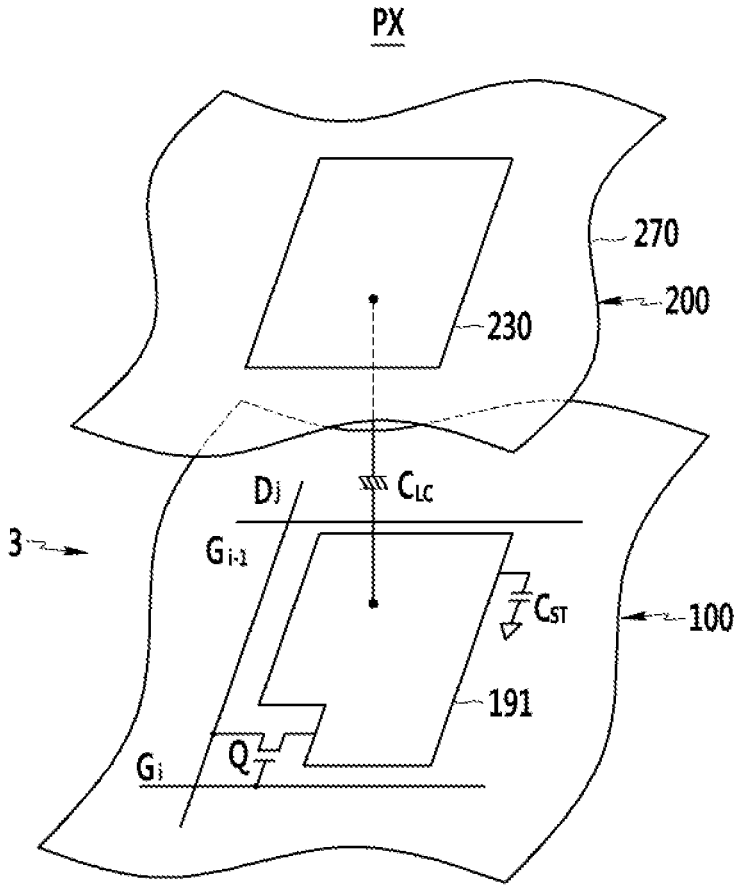
FIG. 2 is an equivalent circuit diagram for one pixel of the display device according to the exemplary embodiment of the present invention.

FIG. 1 is a block diagram of a display device according to an exemplary embodiment of the present invention, and FIG. 2 is an equivalent circuit diagram for one pixel of the display device according to the exemplary embodiment of the present invention.

As illustrated in FIGS. 1 and 2, the display device according to the exemplary embodiment of the present invention includes a liquid crystal panel 300, a gate driver 400 and a data driver 500 connected to the liquid crystal panel 300, and a signal controller 600 controlling the liquid crystal panel 300, the gate driver 400, and the data driver 500.

The display panel 300 includes a plurality of signal lines G1-G(2*n*) and D1-Dm, and a plurality of pixels PX connected to the signal lines and arranged substantially in a matrix form, when viewed from an equivalent circuit. Meanwhile, the display panel 300 includes a lower panel 100 and an upper panel 200 facing each other, and a liquid crystal layer 3 interposed therebetween.

The signal lines G1-G(2*n*) and D1-Dm include a plurality of gate lines G1-G(2*n*) transferring gate signals (referred to as "scanning signals"), and a plurality of data lines D1-Dm transferring data voltages. The gate lines G1-G(2*n*) extend substantially in a row direction and are substantially parallel to each other, and the data lines D1-Dm extend substantially in a column direction and are substantially parallel to each other.

In more detail, one of the data lines D1-Dm may be disposed for every two pixel columns. That is, one data line is present for each pair of pixel columns. The number of data lines may be a half of the number of pixel columns.

Further, a pair of gate lines G1 and G2, G3 and G4, . . . are positioned above and below each pixel row. Also, pixels R, G, and B in one pixel row are connected to any one of the pair of gate lines G1 and G2, G3 and G4, . . . above and below its row. That is, the number of gate lines may be twice the number of pixel rows.

A layout of the pixels R, G, and B of the display panel 300 according to the exemplary embodiment of the present invention will be described. In the display panel 300, a column of blue pixels B expressing blue, a column of red pixels R expressing red, and a column of green pixels G expressing green are alternately arranged and disposed in a row direction. In this example, the display panel 300 may have columns of blue pixels B, columns of red pixels R, and columns of green pixels G sequentially and repetitively disposed, but embodiments of the invention are not necessarily limited thereto. Even though the order of the pixel columns may be changed, the present invention may still be applied. In addition, three primary colored pixels may be arranged in any manner, and other three primary colors other than blue, red, and green may also be used. Meanwhile, in order to implement color display, each pixel PX uniquely displays one of the primary colors (spatial division), or alternately displays primary colors with time (temporal division) so that a desired color may be recognized by the spatial and temporal sum of the primary colors.

A first pixel and a second pixel of a second row are connected to a first data line D1. In this case, the first pixel in the second row is connected to an upper gate line, and the second pixel in the second row is connected to a lower gate line.

The first pixel and second pixel of a first row are connected to a second data line D2. In this case, the first pixel in the first row is connected to an upper gate line, and the second pixel in the first row is connected to a lower gate line. Further, a third pixel and a fourth pixel in the second row are connected to the second data line D2. The third pixel in the second row is connected to the upper gate line, and the fourth pixel in the second row is connected to the lower gate line.

A third pixel and a fourth pixel in the first row are connected to a third data line D3. In this case, the third pixel in the first row is connected to an upper gate line, and the fourth pixel in the first row is connected to a lower gate line. Further, a fifth pixel and a sixth pixel in the second row are connected to the third data line D3. In this case, the fifth pixel in the second row is connected to a lower gate line, and the sixth pixel in the second row is connected to an upper gate line.

A fifth pixel and a sixth pixel in the first row are connected to a fourth data line D4. In this case, the fifth pixel in the first row is connected to a lower gate line, and the sixth pixel in the first row is connected to an upper gate line.

According to this exemplary embodiment of the present invention, in each pixel structure of the display panel 300, the pixel structure described above is repeated. That is, when respective pixels R, G, and B of the display panel 300 are represented in a matrix form, the pixels R, G, and B have a structure in which pixel units (hereinafter, referred to as inversion driving units) of 6×2 size are repeated.

According to the exemplary embodiment of the present invention, each pixel has a first polarity or a second polarity. Further, the polarity of each pixel may be inverted by frame unit. According to the exemplary embodiment of the present invention, the first polarity and the second polarity have opposite polarities. That is, when the first polarity is a positive (+) polarity, the second polarity is a negative (−) polarity, and further, when the first polarity is a negative (−) polarity, the second polarity is a positive (+) polarity.

Each of the pixels R, G, and B includes a pixel electrode 191 receiving a data signal through a switching element Q, such as a thin film transistor, connected to the gate lines G1-G(2*n*) and the data lines D1-Dm, and a common electrode 270 facing the pixel electrode 191 and receiving a common voltage Vcom.

The liquid crystal capacitor Clc includes the pixel electrode 191 of the lower panel 100 and the common electrode 270 of the upper panel 200 as two terminals, and the liquid crystal layer 3 between the two electrodes 191 and 270 serves as a dielectric material. The pixel electrode 191 is connected to the switching element Q, and the common electrode 270 is formed on substantially the entire surface of the upper panel 200 to receive a common voltage Vcom. Unlike FIG. 2, the common electrode 270 can be provided on the lower panel 100, and in this case, at least one of the two electrodes 191 and 270 may be formed in a linear shape or a rod shape.

A storage capacitor Cst providing a storage capacitance for the liquid crystal capacitor Clc is formed when a separate signal line (not illustrated) provided on the lower panel 100 and the pixel electrode 191 overlap each other with an insulator therebetween, and a predetermined voltage such as a common voltage Vcom is applied to the separate signal line. However, the storage capacitor Cst may also be formed when the pixel electrode 191 overlaps the gate line of a different pixel.

FIG. 2 illustrates that each pixel PX may include a color filter 230 expressing one of the primary colors and positioned in a region of the upper panel 200 corresponding to the pixel electrode 191, as an example of spatial division. That is, three pixels PX expressing red, green, and blue form one dot expressing one color. The color filter 230 may be disposed above or below the pixel electrode 191 of the lower panel 100.

At least a pair of polarizers can polarize light, and be attached onto an outer surface of the display panel 300.

Referring back to FIG. 1, the gate driver 400 is connected to the gate lines G1-G(2*n*) of the display panel 300 to apply gate signals, configured by a combination of a gate-on voltage Von turning on the switching elements and a gate-off voltage Voff turning off the switching elements, to the gate lines G1-G(2*n*).

In more detail, the gate driver 400 receives a control signal from the signal controller 600 to apply the gate-on voltage Von to the gate lines G1-G(2*n*) during a main-charging period. Further, the gate driver 400 receives a control signal from the signal controller 600 to selectively apply the gate-on voltage Von or the gate-off voltage Voff to the gate lines G1-G(2*n*) during a first or second pre-charging period. A process will be described below in detail, in which the gate driver 400 receives a control signal from the signal controller 600 to selectively apply the gate-on voltage Von or the gate-off voltage Voff to the gate lines G1-G(2*n*) during the first or second pre-charging period.

The gate driver 400 applies the gate-on voltage Von to the gate lines G1-G(2*n*) according to a gate control signal CONT1 from the signal controller 600 to turn on the switching elements Q connected to the gate lines G1-G(2*n*). Then, the data voltages applied to the data lines D1-Dm are applied to the corresponding pixels PX through the turned-on switching elements Q.

A difference between the data voltage applied to the pixel PX and the common voltage Vcom is represented as a charging voltage of the liquid crystal capacitor Clc, that is, a pixel voltage. The arrangement of the liquid crystal molecules varies according to a magnitude of the pixel voltage, and as a result, polarization of light passing through the liquid crystal layer 3 is changed. The change in the polarization is represented as a change in transmittance of light by a polarizer attached onto the display panel 300, and as a result, the pixel PX displays luminance represented by a gray of an image signal DAT.

The process is repeated for each horizontal period (referred to as "1H", and being the same as one period of a horizontal synchronizing signal Hsync and a data enable signal DE), and as a result, the gate-on voltages Von are sequentially applied to all the gate lines G1-G(2*n*), and the data voltages are applied to all the pixels PX, thereby displaying an image for one frame.

Meanwhile, when voltages are applied to both ends of the liquid crystal capacitor Clc, the liquid crystal molecules of the liquid crystal layer 3 are rearranged to a stable state corresponding to the voltage, but since a response speed of the liquid crystal molecules is slow, some time is required until the liquid crystal molecules reach this stable state. When the voltage applied to the liquid crystal capacitor Clc is maintained at a particular level, the liquid crystal molecules continuously move until the liquid crystal molecules reach the stable state, and light transmittance varies during that time. When the liquid crystal molecules reach the stable state and then do not move any more, the light transmittance further becomes uniform.

As such, when the pixel voltage in the stable state is referred to as a target voltage and light transmittance is referred to as a target light transmittance, the target voltage and the target light transmittance have one to one correspondence. Further, when reaching the target voltage, a charging amount of the liquid crystal capacitor Clc of the pixel is referred to as a target charging amount.

The data driver 500 is connected to the data lines D1-Dm of the display panel 300 to apply a data voltage to the data lines D1-Dm.

The signal controller 600 receives input image signals R, G and B, and an input control signal controlling display of the input image signals R, G and B, from an external graphic controller (not illustrated). The input image signals R, G and B store luminance information for each pixel PX, and luminance has a predetermined number of grays, for example, 1024 (=2^10), 256 (=2^8), or 64 (=2^6) grays. The input control signal includes a vertical synchronizing signal Vsync, a horizontal synchronizing signal Hsync, a main clock MCLK, a data enable signal DE, and the like.

The signal controller 600 generates and properly processes input image signals R, G, and B and an input image signal DAT based on an input control signal, and generates a gate control signal CONT1, a data control signal CONT2, and the like. Thereafter, the signal controller 600 transmits the gate control signal CONT1 to the gate driver 400, and transmits the data control signal CONT2 and the processed image signal DAT to the data driver 500.

The gate control signal CONT1 includes a scanning start signal STV instructing scanning start, and at least one clock signal controlling an output period of the gate-on voltage Von. The gate control signal CONT1 may further include an output enable signal OE limiting a duration time of the gate-on voltage Von.

The data control signal CONT2 includes a horizontal synchronization start signal STH notifying transmission start of the output image signals DAT for one set of pixels PX, a load signal LOAD instructing a data voltage to be applied to the display panel 300, and a data clock signal HCLK. The data control signal CONT2 may further include an inversion signal RVS inverting a voltage polarity of the data voltage for the common voltage Vcom (hereinafter, referred to as a "polarity of the data signal" which is shorthand for a "voltage polarity of the data signal for the common voltage").

According to the data control signal CONT2 from the signal controller 600, the data driver 500 receives the digital output image signal DAT for one set of pixels PX and selects a gray voltage corresponding to each digital output image signal DAT, converts the gray voltage into an analog data voltage, and then applies the converted analog data voltage to the corresponding data lines D1-Dm.

Hereinafter, a selective pre-charging according to the exemplary embodiment of the present invention will be described. The gate driver 400 according to the exemplary embodiment of the present invention receives control signals from the signal controller 600 to apply the gate-on voltage Von to the gate line. When the gate-on voltage Von is applied to the gate line, the data voltage is applied to the pixel connected to the gate line to which the gate-on voltage Von is applied, and the liquid crystal capacitor Clc of the pixel is charged according to the applied data voltage.

According to exemplary embodiments of the present invention, there are three periods in which the liquid crystal capacitor Clc of the pixel is charged according to the gate-on voltage. The three periods according to the exemplary embodiment of the present invention include a first pre-charge period Pre1 in which the liquid crystal capacitor Clc of a before-last (or before-previous) pixel is charged, a second pre-charge period Pre2 in which the liquid crystal capacitor Clc of a previous pixel is charged, and a main-charge period Main in which the liquid crystal capacitor Clc of a current pixel is charged.

Further, the signal controller 600 may control the gate driver 400 to apply the gate-on voltage Von or the gate-off voltage Voff to the gate line connected to the current pixel during the first pre-charge period, the second pre-charge period, or the main-charge period.

The signal controller 600 according to the exemplary embodiment of the present invention determines whether a time required for the liquid crystal capacitor Clc of each pixel to reach a target charging amount exists, based on input image signals R, G, and B. That is, the signal controller 600 according to the exemplary embodiment of the present invention determines whether the first pre-charge or the second pre-charge is required for the charging amount of the liquid crystal capacitor Clc of each pixel to reach a target charging amount. This determination is made according to a relationship with the data voltage applied to the data line connected to each pixel based on input image signals R, G, and B. More specifically, the signal controller 600 selects a pre-charging method from among various pre-charging methods, according to the pattern of the data voltage applied to the data line. Since the signal controller 600 makes this determination simply based on the specific pattern used, data throughput is reduced.

According to the exemplary embodiment of the present invention, the gate driver 400 receives a control signal from the signal controller 600 to apply the gate-on voltage Von or the gate-off voltage Voff to the pixel to which the gate line is connected during the first pre-charge period or the second pre-charge period. Hereinafter, it will be described that the gate-on voltage Von has a high level, and the gate-off voltage Voff has a low level. However, the present invention is not limited thereto, and may also be applied to a gate-on voltage Von having a low level and a gate-off voltage Voff having a high level.

The driving devices 400, 500, and 600 may be integrated into the display panel 300 together with the signal lines G1-G(2n) and D1-Dm, and the switching elements Q. Alternatively, the driving devices 400, 500, and 600 may be directly installed on the display panel 300 in at least one IC chip form, installed on a flexible printed circuit film (not illustrated) to be attached to the display panel 300 in a tape carrier package (TCP) form, or installed on a separate printed circuit board (not illustrated). Further, the driving devices 400, 500, and 600 may be integrated into a single chip, or at least one of the driving devices or at least one circuit element configuring the driving devices may be positioned outside of the single chip.

Next, an operating method of the present invention will be described with reference to FIGS. 3 to 8.

Figure 3:
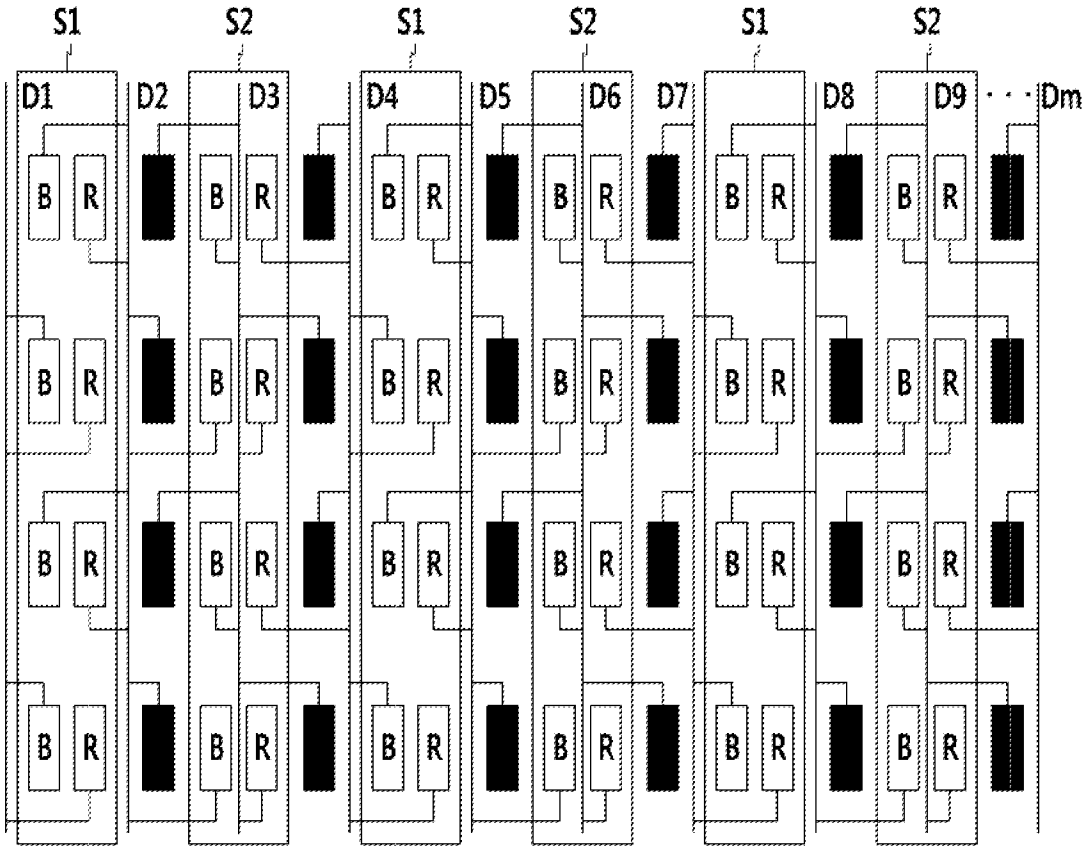
FIG. 3 is a diagram illustrating pixels in a matrix form according to the exemplary embodiment of the present invention.

FIG. 3 is a diagram illustrating pixels in a matrix form according to the exemplary embodiment of the present invention.

In FIG. 3, a blue pixel B and a red pixel R may be first grays, and a green pixel G may be a second gray. Further, in this specification, the first gray may be a maximum gray, and the second gray may be a minimum gray. This means that a change of the data voltage is large from the maximum gray to the minimum gray, and a gray value equivalent to the maximum gray and a gray value equivalent to the minimum gray may have similar characteristics.

In step S1 of FIG. 3, two adjacent pixels in the same row are connected to the same data line. In step S2, the two adjacent pixels in the same row are connected to different data lines, respectively. Further, in step S2, previous pixels from these two pixels in the same row may be pixels having the second gray, respectively.

In step S1, thereafter, when the gate-on voltage Von is applied to the gate line connected to the current pixel during the main-charge period, the liquid crystal capacitor Clc of the current pixel is charged up to the target charging amount. As a result, during the main-charge period, the gray of the current pixel reaches the target gray.

During the main-charge period, since the charging amount of the liquid crystal capacitor Clc of the current pixel starts from a sufficiently high voltage, that is, the target voltage or less, the charging amount may reach up to the sufficient target charging amount. The reason is that in step S1, during the second pre-charge period, the gate-on voltage Von is applied to the gate line connected to the current pixel, and further, the gray of the previous pixel of the current pixel is the first gray. As a result, since during the second pre-charge period, the liquid crystal capacitor Clc of the current pixel is charged to the target amount or less, thereafter, during the main-charge period, sufficient time exists for the capacitor Clc to be charged up to the target charging amount.

In step S2, when the gate-on voltage Von is applied to the gate line connected to the current pixel during the second pre-charge period, the liquid crystal capacitor Clc of the current pixel is charged to 5 V or less, that is, the common voltage or less.

Thereafter, when the gate-on voltage Von is applied to the gate line connected to the current pixel during the main-charge period, the liquid crystal capacitor Clc of the current pixel is charged. However, in step S2, since the charging amount of the liquid crystal capacitor Clc of the current pixel during the main-charge period starts from a very low voltage, only one pre-charging does not reach up to the target charging amount. Accordingly, the gate driver 400 according to the present invention may perform pre-charging by applying the gate-on voltage Von to the gate line connected to the current pixel even during the first pre-charge period. According to the present invention, if the charging amount of the liquid crystal capacitor Clc of the current pixel charged by the pre-charging corresponding to the gate-on voltage Von of the first pre-charge period is sufficient so that the liquid crystal capacitor Clc of the current pixel is charged to its target charging amount during the main-charge period, the gate driver 400 need not perform pre-charging during the second pre-charge period.

Further, referring to FIG. 3, the liquid crystal capacitor Clc of each pixel according to the present invention is charged in an order connected to the data line.

For example, the liquid crystal capacitor Clc of the first pixel of the first row (connected to D2), the liquid crystal capacitor Clc of the second pixel of the first row, the liquid crystal capacitor Clc of the third pixel of the second row, and the liquid crystal capacitor Clc of the fourth pixel of the second row are charged in sequence.

Figure 4:
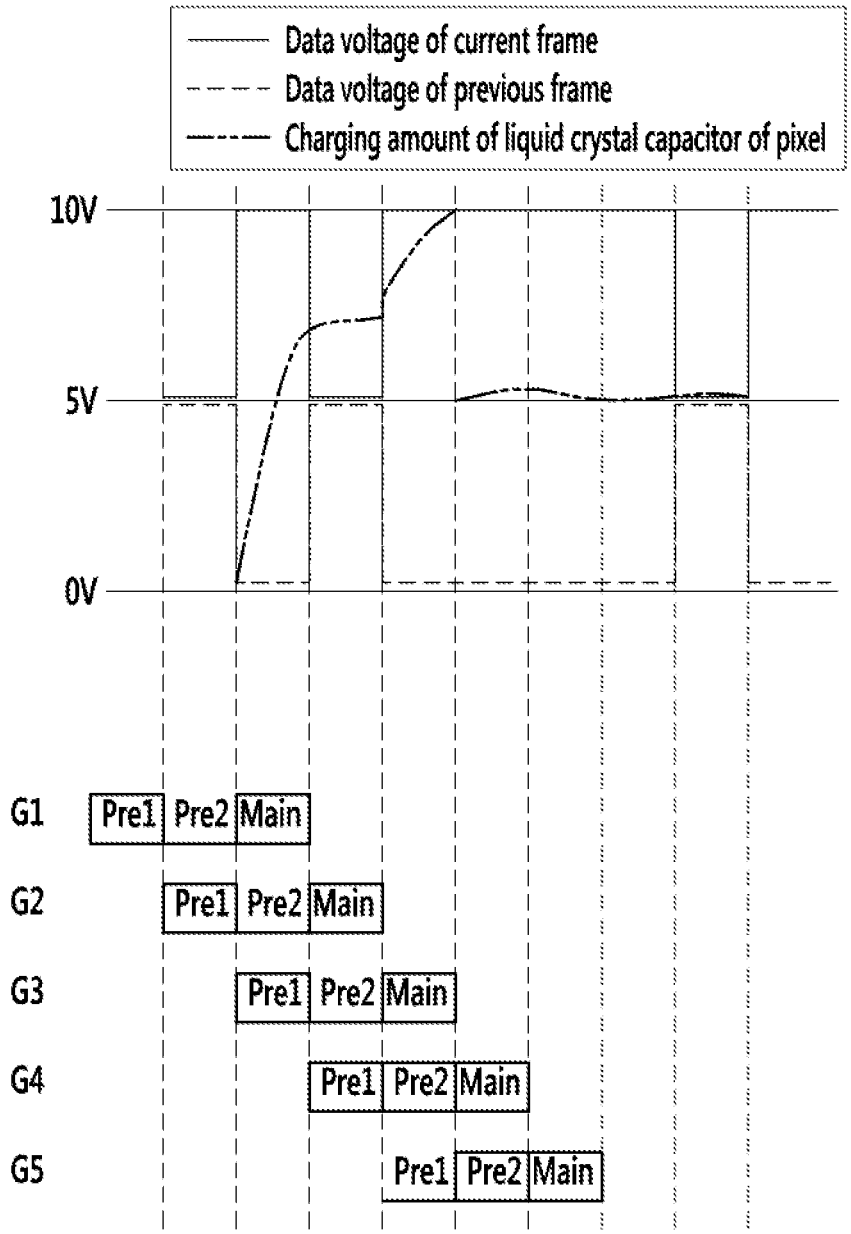
FIG. 4 is a diagram illustrating a gate signal according to the exemplary embodiment of the present invention.

FIG. 4 is a diagram illustrating a gate signal according to the exemplary embodiment of the present invention.

According to the exemplary embodiment of the present invention, as illustrated in FIG. 4, respective gate signals having different forms may be applied to the respective gate lines G1-G(2*n*) in different situations.

According to the exemplary embodiment of the present invention, the gate driver 400 may apply the gate-off voltage Voff to the gate lines G1-G(2*n*) during the first pre-charge period in the case where the pre-charging for the first pre-charge period is not required.

The signal controller 600 determines a target charging amount for the liquid crystal capacitor Clc of the current pixel, and calculates forms of the gate signals to be applied to the respective gate lines G1-G(2*n*) in response to the target charging amount. Further, the signal controller 600 controls the gate driver 400 so as to output the calculated gate signal.

Hereinafter are examples of the application of gate signals having different forms.

Figure 5:
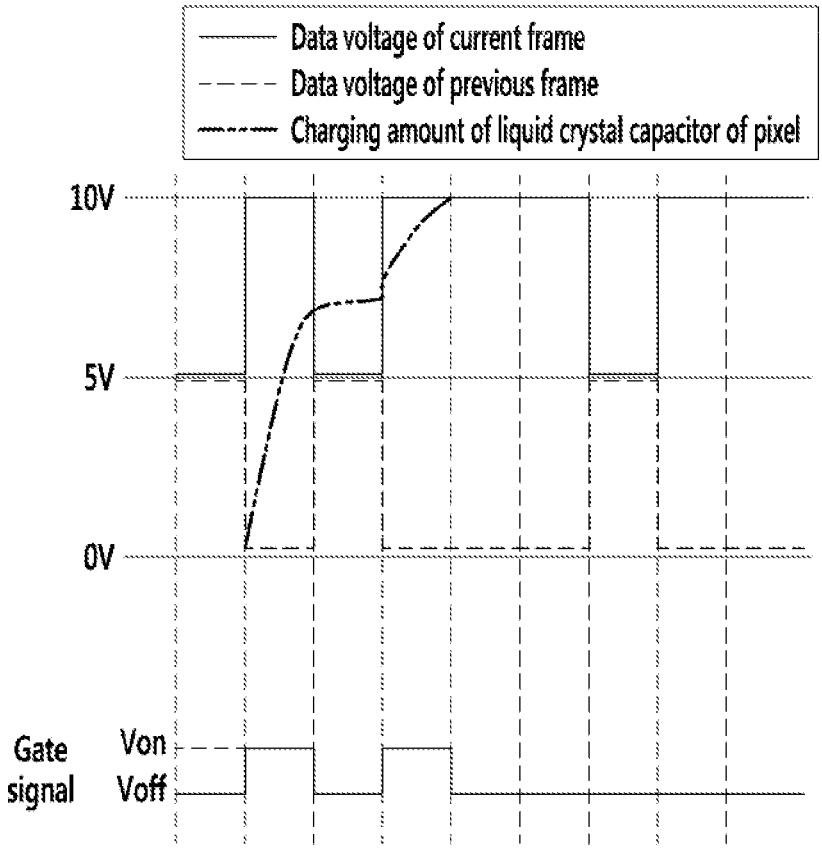
FIG. 5 is a diagram illustrating a charging amount of a liquid crystal capacitor according to a first exemplary embodiment of the present invention.

FIG. 5 is a diagram illustrating a charging amount of a liquid crystal capacitor according to a first exemplary embodiment of the present invention.

The signal controller 600 applies the gate signal for the gate line connected to the current pixel of the gate driver 400, so that the current pixel (also referred to as a current stage pixel) achieves a target gray during the main-charge period. For the pixel of FIG. 5, when the second gray is applied to the previous stage pixel before the first gray applied during the main-charge period and pre-charging is performed by the second gray, the current stage pixel may not reach the target voltage, and as a result, the first gray voltage of a before-last pixel (also referred to as a before-last stage pixel) of the current pixel is used as the pre-charging voltage.

Hereinafter, the target gray means the gray of the current pixel when the amount of charge of the liquid crystal capacitor Clc of the current pixel is at the target charging amount.

There are three periods in which the liquid crystal capacitor Clc of the pixel is charged according to the gate-on voltage, in the exemplary embodiment. The three periods according to the exemplary embodiment of the present invention include a first pre-charge period Pre in which the liquid crystal capacitor Clc of a before-last pixel is charged, a second pre-charge period Pre in which the liquid crystal capacitor Clc of a previous pixel is charged, and a main-charge period Main in which the liquid crystal capacitor Clc of a current pixel is charged.

According to FIG. 5, when the target gray of the current pixel (also referred to as a current stage pixel) is the first gray, and the gray of the before-last pixel (referred to as a before-last stage pixel) during the first pre-charge period and the gray of the previous pixel (referred to as a current stage pixel) during the second pre-charge period are the second gray, the signal controller 600 controls the gate driver 400 to apply the gate-on voltage Von during the first pre-charge period and to apply the gate-off voltage Voff during the second pre-charge period. When describing FIG. 3 as an example, the fourth pixel in the first row may be a before-last stage pixel, the sixth pixel in the second row may be the previous stage pixel, and the fifth pixel in the second row may be the current stage pixel.

According to FIG. 5, when the gate-on voltage Von during the first pre-charge period is applied to the gate line connected to the current pixel, the liquid crystal capacitor Clc of the current pixel is charged with 5 V or more, that is, a common voltage or more. Hereinafter, an example in which the common voltage is 5 V is described, but the present invention is not limited thereto. The present invention may be applied to common voltages having any magnitudes.

Thereafter, when the gate-off voltage Voff is applied to the gate line connected to the current pixel during the second pre-charge period, the charging voltage of the liquid crystal capacitor Clc of the current pixel is substantially maintained.

According to the first exemplary embodiment of the present invention, the gate driver 400 applies the gate-on voltage Von of the second pre-charge period to the gate line connected to the current pixel to charge the liquid crystal capacitor Clc of the current pixel to 10 V or less, that is, the target charging amount or less.

Thereafter, when the gate-on voltage Von is applied to the gate line connected to the current pixel during the main-charge period, the liquid crystal capacitor Clc of the current pixel is charged up to the target charging amount. As a result, during the main-charge period, the gray of the current pixel reaches the target gray.

According to the first exemplary embodiment of the present invention, when the target gray of the current pixel is the first gray, the gate driver 400 may apply the gate-on voltage Von to the gate line connected to the current pixel during the first pre-charge period.

Figure 6:
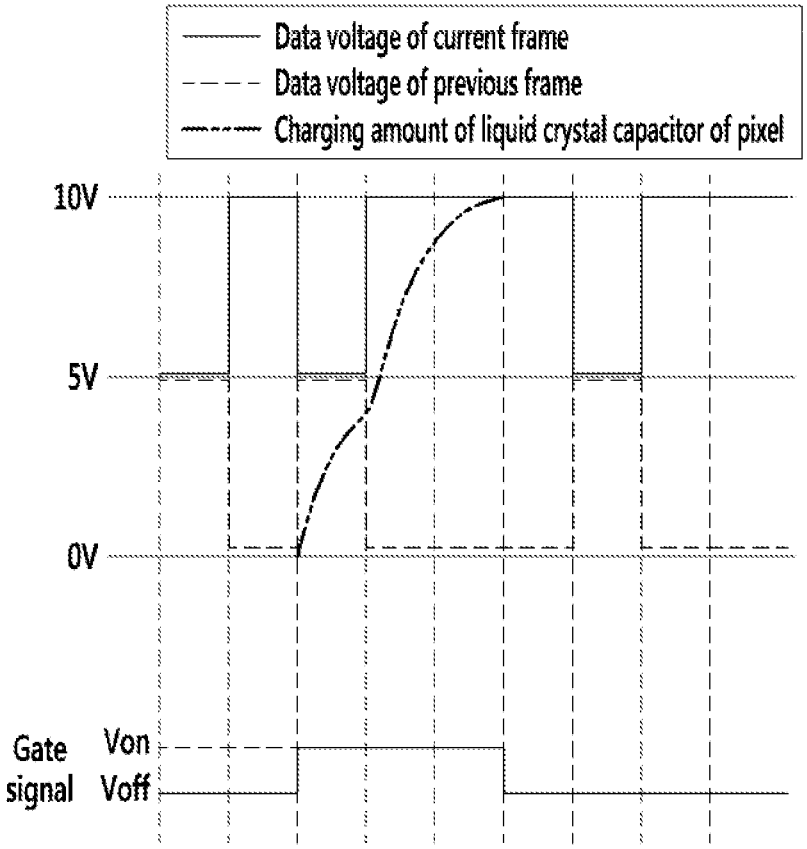
FIG. 6 is a diagram illustrating a charging amount of a liquid crystal capacitor according to a second exemplary embodiment of the present invention.

FIG. 6 is a diagram illustrating a charging amount of a liquid crystal capacitor according to a second exemplary embodiment of the present invention.

The signal controller 600 applies the gate signal for the gate line connected to the current pixel of the gate driver 400 so that the current pixel (also referred to as a current stage pixel) has a target gray during the main-charge period. In the pixel of FIG. 6, the first gray is applied to the previous stage pixel before the first gray applied during the pre-charging period, and the current stage pixel is pre-charged by the first gray to reach the target voltage. Accordingly, in this case, the pre-charging may be performed or not during the first pre-charge period. However, in this case, when the pre-charging is performed during the first pre-charge period, the current stage pixel may more rapidly reach the target voltage.

According to FIG. 6, when the target gray of the current pixel is the first gray, the gray of the before-last pixel during the first pre-charge period is the second gray, and the gray of the previous pixel during the second pre-charge period is the first gray, the signal controller 600 controls the gate driver 400 to apply the gate-on voltage Von to the gate line connected to the current pixel during the first pre-charge period, and to apply the gate-on voltage Von to the gate line connected to the current pixel during the second pre-charge period. When describing FIG. 3 as an example, the sixth pixel in the first row may be the before-last stage pixel, the fifth pixel in the first row may be the previous stage pixel, and the seventh pixel in the second row may be the current stage pixel.

According to FIG. 6, when the gate-on voltage Von during the first pre-charge period is applied to the gate line connected to the current pixel, the liquid crystal capacitor Clc of the current pixel is charged with 5V or less, that is, a common voltage or less.

Thereafter, when the gate-on voltage Von is applied to the gate line connected to the current pixel during the second pre-charge period, the liquid crystal capacitor Clc of the current pixel is charged up to 10 V or less, that is, the target charging amount or less.

Thereafter, when the gate-on voltage Von is applied to the gate line connected to the current pixel during the main-charge period, the liquid crystal capacitor Clc of the current pixel is charged up to the target charging amount. As a result, during the main-charge period, the gray of the current pixel reaches the target gray.

According to the second exemplary embodiment of the present invention, when the target gray of the current pixel is the first gray, the gate driver 400 may apply the gate-on voltage Von to the gate line connected to the current pixel during the first pre-charge period or the second pre-charge period.

Figure 7:
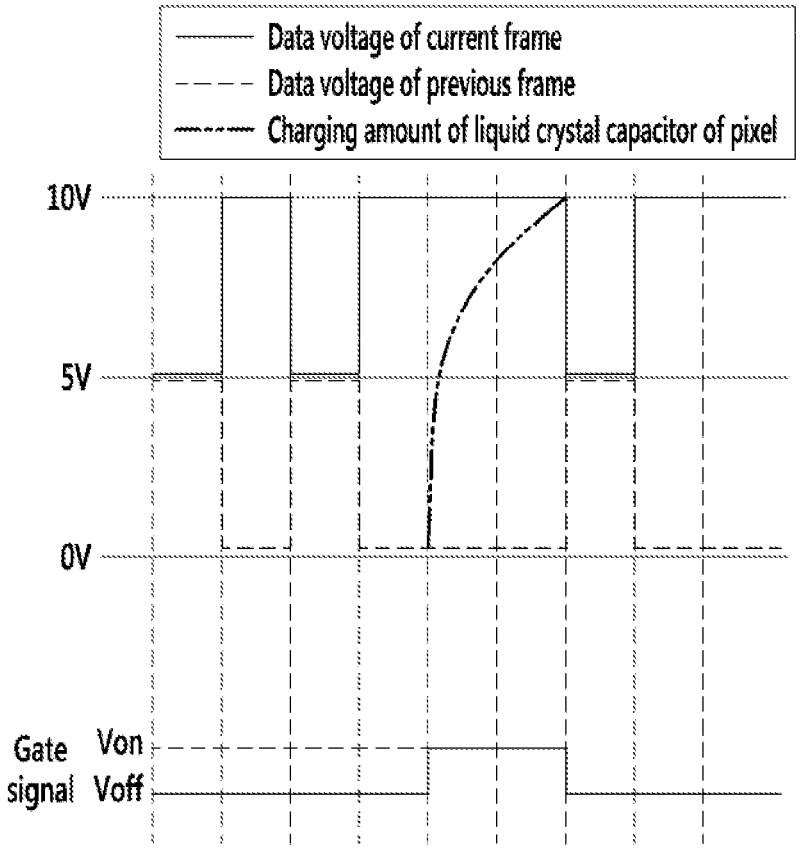
FIG. 7 is a diagram illustrating a charging amount of a liquid crystal capacitor according to a third exemplary embodiment of the present invention.

FIG. 7 is a diagram illustrating a charging amount of a liquid crystal capacitor according to a third exemplary embodiment of the present invention.

The signal controller 600 applies the gate signal for the gate line connected to the current pixel of the gate driver 400 so that the current pixel (also referred to as a current stage pixel) has a target gray during the main-charge period. In the pixel of FIG. 7, the first gray is applied to the previous stage pixel before the first gray applied during the pre-charging period, and the current stage pixel is pre-charged by the first gray to reach the target voltage. Accordingly, in this case, pre-charging need not necessarily be performed during the first pre-charge period. However, in this case, when the pre-charging is performed during the first pre-charge period, the current stage pixel may more rapidly reach the target voltage.

According to FIG. 7, when the target gray of the current pixel is the first gray, the gray of the before-last pixel during the first pre-charge period is the first gray, and the gray of the previous pixel during the second pre-charge period is the first gray, the signal controller 600 controls the gate driver 400 to apply the gate-off voltage Voff to the gate line connected to the current pixel during the first pre-charge period, and to apply the gate-on voltage Von to the gate line connected to the current pixel during the second pre-charge period. When describing FIG. 3 as an example, an eleventh pixel in the first row may be a before-last stage pixel, a thirteenth pixel in the second row may be a previous stage pixel, and a fourteenth pixel in the second row may be a current stage pixel.

According to the third exemplary embodiment of the present invention, the gate driver 400 may apply the gate-on voltage Von to the gate line connected to the current pixel during the second pre-charge period.

According to FIG. 7, when the gate-off voltage Voff is applied to the gate line connected to the current pixel during the first pre-charge period, the liquid crystal capacitor Clc of the current pixel is not charged.

Thereafter, when the gate-on voltage Von is applied to the gate line connected to the current pixel during the second pre-charge period, the liquid crystal capacitor Clc of the current pixel may be charged to 10V or less, that is, the common voltage or less.

Thereafter, when the gate-on voltage Von is applied to the gate line connected to the current pixel during the main-charge period, the liquid crystal capacitor Clc of the current pixel is charged up to the target charging amount. As a result, during the main-charge period, the gray of the current pixel reaches the target gray.

Figure 8:
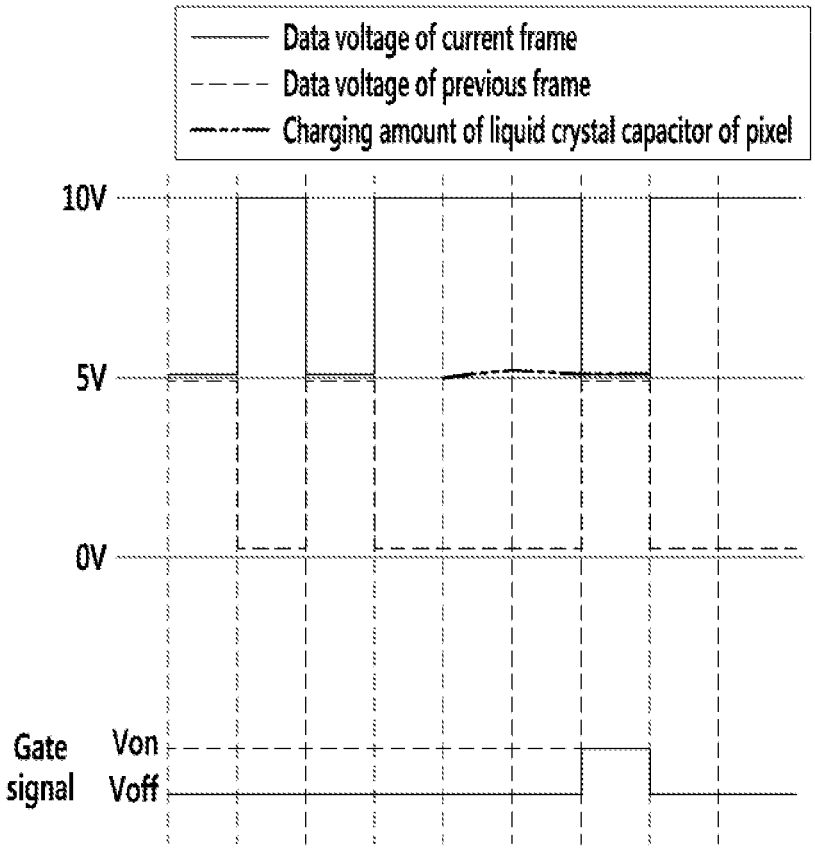
FIG. 8 is a diagram illustrating a charging amount of a liquid crystal capacitor according to a fourth exemplary embodiment of the present invention.

FIG. 8 is a diagram illustrating a charging amount of a liquid crystal capacitor according to a fourth exemplary embodiment of the present invention.

The signal controller 600 performs the pre-charging during the first pre-charge period or the second pre-charge period. According to the embodiments, the signal controller 600 may not perform pre-charging during the first pre-charge period and the second pre-charge period in case the current pixel (also referred to as a current stage pixel) has a target gray during the main-charge period.

According to FIG. 8, when the target gray of the current pixel is the second gray, the gray of the before-last pixel during the first pre-charge period is the first gray, and the gray of the previous pixel during the second pre-charge period is the first gray, the signal controller 600 controls the gate driver 400 to apply the gate-off voltage Voff to the gate line connected to the current pixel during the first pre-charge period, and to apply the gate-on voltage Von to the gate line connected to the current pixel during the second pre-charge period. When describing FIG. 3 as an example, the first pixel in the first row may be a before-last stage pixel, the second pixel in the first row may be the previous stage pixel, and the third pixel in the second row may be the current stage pixel.

According to FIG. 8, when the gate-off voltage Voff is applied to the gate line connected to the current pixel during the first pre-charge period, the liquid crystal capacitor Clc of the current pixel is not charged.

Thereafter, when the gate-off voltage Voff is applied to the gate line connected to the current pixel during the second pre-charge period, the liquid crystal capacitor Clc of the current pixel is not charged.

Thereafter, when the gate-on voltage Von is applied to the gate line connected to the current pixel during the main-charge period, the liquid crystal capacitor Clc of the current pixel is charged up to the target charging amount. As a result, during the main-charge period, the gray of the current pixel reaches the target gray.

According to the fourth exemplary embodiment of the present invention, when the target gray of the current pixel is the second gray, the gate driver 400 may apply the gate-off voltage Voff to the gate line connected to the current pixel during the first pre-charge period and the second pre-charge period.

Next, a pixel structure of the display panel 300 according to another exemplary embodiment of the present invention will be described with reference to FIGS. 9 and 10.

Figure 9:
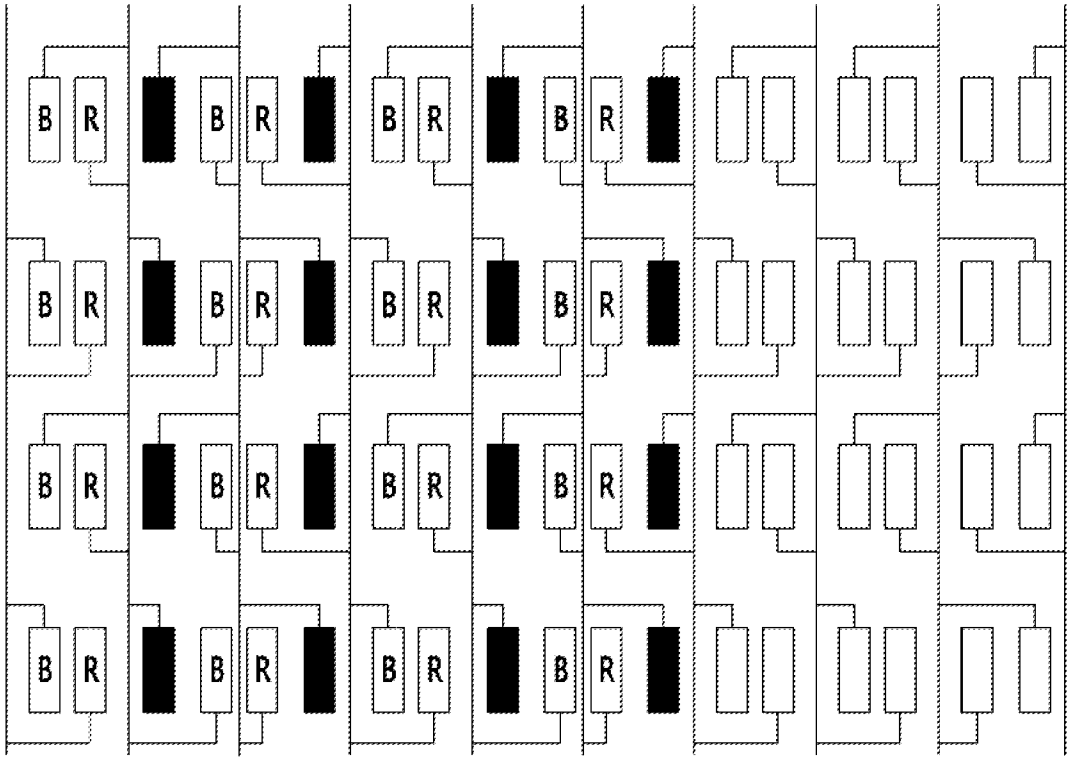
FIG. 9 is a diagram illustrating respective pixels in a matrix form for a display panel according to another exemplary embodiment of the present invention.

FIG. 9 is a diagram illustrating respective pixels in a matrix form for a display panel according to another exemplary embodiment of the present invention.

According to another exemplary embodiment of the present invention, the present invention may also be applied to a case where inversion driving units of 6×2 size described in FIG. 1 are disposed.

According to FIG. 9, only some of the pixel units (hereinafter, referred to as inversion driving units) having 6×2 size described in FIG. 1 are disposed, and the remaining pixels may be applied to a case of having the first gray.

Figure 10:
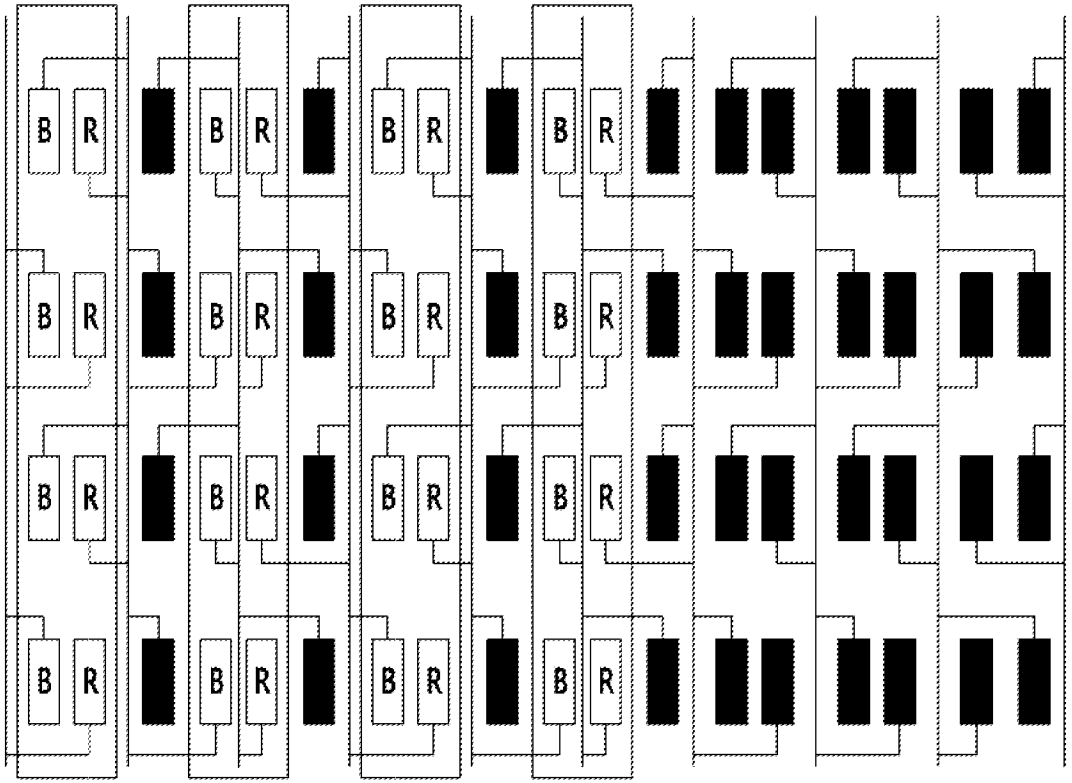
FIG. 10 is a diagram illustrating respective pixels in a matrix form for a display panel according to another exemplary embodiment of the present invention.

FIG. 10 is a diagram illustrating respective pixels in a matrix form of a display panel according to another exemplary embodiment of the present invention.

According to another exemplary embodiment of the present invention, the present invention may also be applied to a case where inversion driving units of 6×2 size described in FIG. 1 are disposed.

According to FIG. 10, only some of the pixel units (hereinafter, referred to as inversion driving units) having 6×2 size described in FIG. 1 are disposed, and the remaining pixels may be applied to a case of having the second gray.

Next, an operation of a display device according to Comparative Examples will be described with reference to FIGS. 11 to 13.

Figure 11:
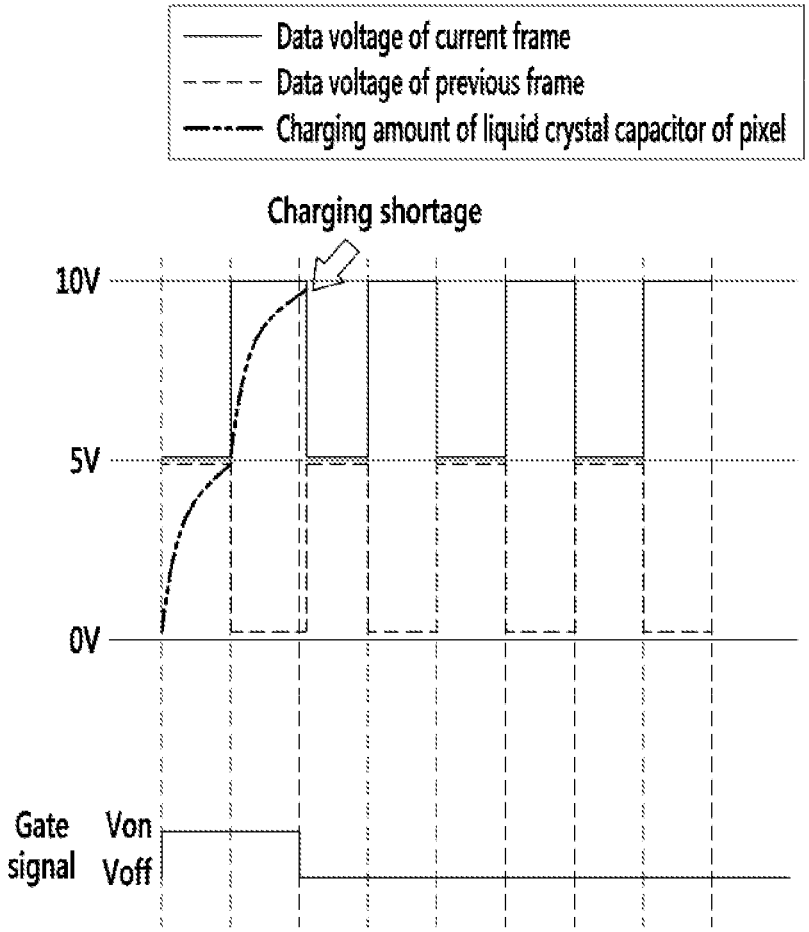
FIG. 11 is a diagram illustrating a charging amount of a liquid crystal capacitor according to a first Comparative Example.

FIG. 11 is a diagram illustrating a charging amount of a liquid crystal capacitor according to a first Comparative Example.

According to the first Comparative Example, when the target gray of the current pixel is the first gray and the gray of the previous pixel during the second pre-charging period is the second gray, the signal controller 600 controls the gate driver 400 to apply the gate-on voltage Von to the gate line connected to the current pixel during the second pre-charge period.

According to FIG. 11, when the gate-on voltage Von is applied to the gate line connected to the current pixel during the second pre-charge period, the liquid crystal capacitor Clc of the current pixel is charged to 5 V or less, that is, the common voltage or less.

Thereafter, when the gate-on voltage Von is applied to the gate line connected to the current pixel during the main-charge period, the liquid crystal capacitor Clc of the current pixel is charged. However, according to the first Comparative Example, since the charging amount of the liquid crystal capacitor Clc of the current pixel during the main-charge period starts from a very low voltage, the charging amount does not reach up to the target charging amount. That is, in the first Comparative Example, a charging shortage may occur. More specifically, the time required charging up to the target charging amount exceeds the main-charge period because the charging is performed from a very low voltage when charging starts during the second pre-charge period.

Figure 12:
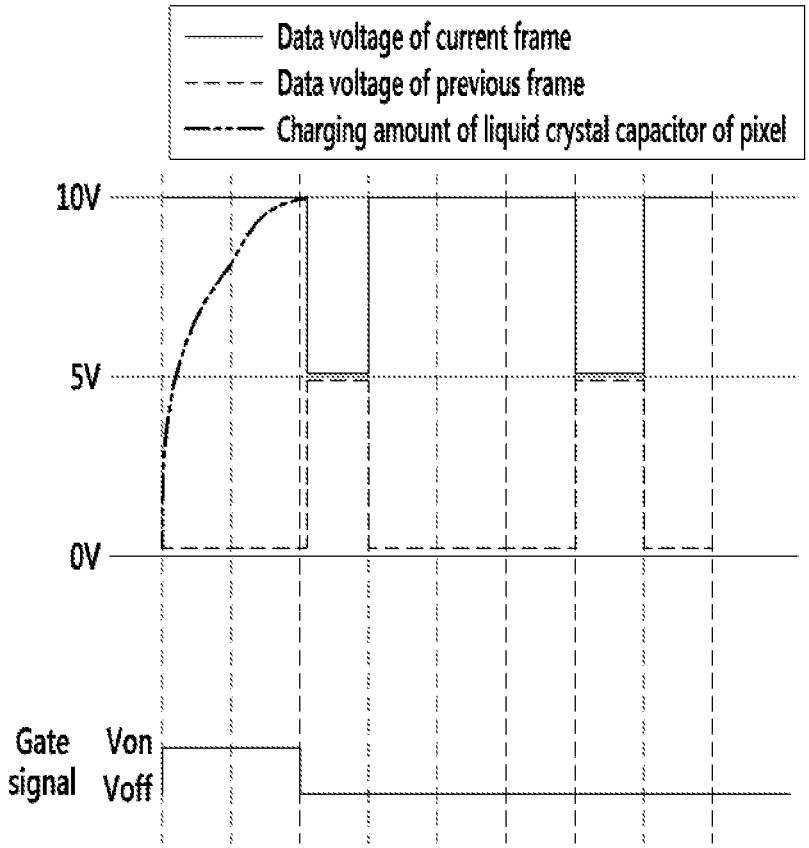
FIG. 12 is a diagram illustrating a charging amount of a liquid crystal capacitor according to a second Comparative Example.

FIG. 12 is a diagram illustrating a charging amount of a liquid crystal capacitor according to a second Comparative Example.

According to the second Comparative Example, when the target gray of the current pixel is the first gray and the gray of the previous pixel during the second pre-charging period is also the first gray, the signal controller 600 controls the gate driver 400 to apply the gate-on voltage Von to the gate line connected to the current pixel during the second pre-charge period.

According to FIG. 12, when the gate-on voltage Von is applied to the gate line connected to the current pixel during the second pre-charge period, the liquid crystal capacitor Clc of the current pixel is charged to 10V or less, that is, the common voltage or less.

Thereafter, when the gate-on voltage Von is applied to the gate line connected to the current pixel during the main-charge period, the liquid crystal capacitor Clc of the current pixel is charged up to the target charging amount. As a result, during the main-charge period, the gray of the current pixel reaches the target gray.

According to the second Comparative Example, during the main-charge period, since the charging amount of the liquid crystal capacitor Clc of the current pixel starts from a sufficiently high voltage, that is, the target voltage or perhaps slightly less, the charging amount may reach up to the sufficient target charging amount. That is, according to the second Comparative Example, when the gate-on voltage Von is applied to the gate line connected to the current pixel during the second pre-charge period, and further, the gray of the previous pixel of the current pixel is the first gray, the liquid crystal capacitor Clc of the current pixel is charged to sufficient amount that the target charging amount is reached during the main-charge period.

Figure 13:
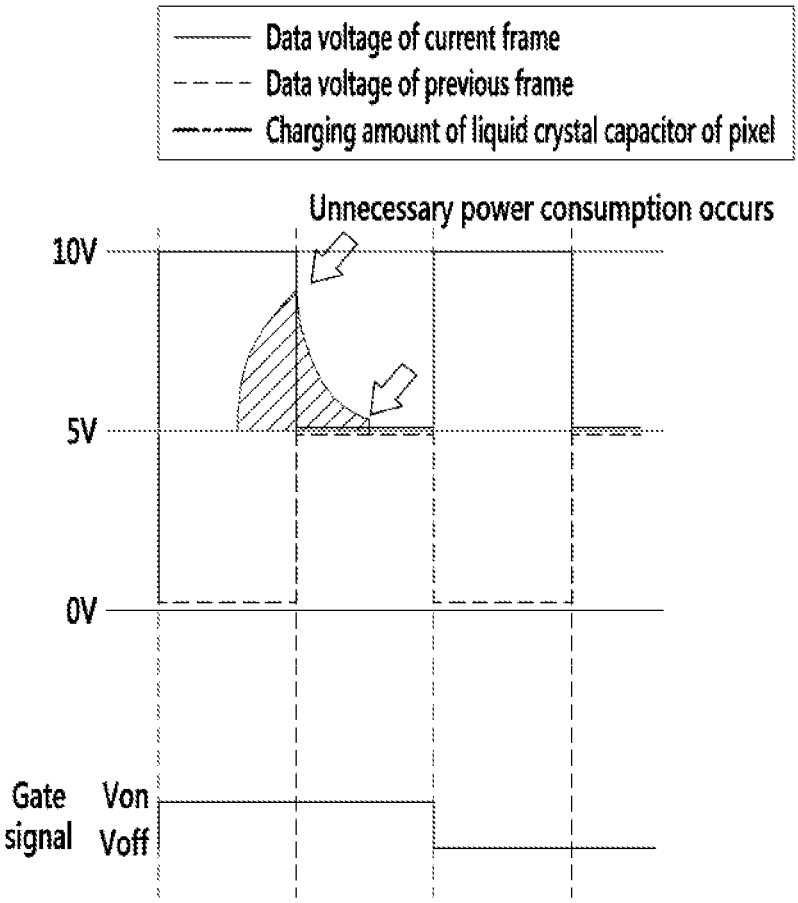
FIG. 13 is a diagram illustrating a charging amount of a liquid crystal capacitor according to a third Comparative Example.

FIG. 13 is a diagram illustrating a charging amount of a liquid crystal capacitor according to a third Comparative Example.

According to the third Comparative Example, when the target gray of the current pixel is the second gray and the gray of the previous pixel during the second pre-charging period is the first gray, the signal controller 600 controls the gate driver 400 to apply the gate-on voltage Von to the gate line connected to the current pixel during the second pre-charge period.

According to FIG. 13, when the gate-on voltage Von is applied to the gate line connected to the current pixel during the second pre-charge period, the liquid crystal capacitor Clc of the current pixel is charged to 10V or less, that is, the common voltage or less.

Thereafter, when the gate-on voltage Von is applied to the gate line connected to the current pixel during the main-charge period, the liquid crystal capacitor Clc of the current pixel is charged. However, according to the third Comparative Example 3, since the charging amount of the liquid crystal capacitor Clc of the current pixel during the main-charge period starts from an excessively high voltage, the charging amount does not reach up to the target charging amount.

That is, according to the third Comparative Example, during the second pre-charge period, the charging amount of the liquid crystal capacitor Clc of the current pixel is charged to the target charging amount or more, and as a result, excessive power consumption occurs. Further, during the main-charge period, since the charging amount of the liquid crystal capacitor Clc of the current pixel starts from an excessively high voltage, the charging amount does not reach the target charging amount.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

300: Display panel
400: Gate driver
500: Data driver
600: Signal controller

What is claimed is:

1. A display device, comprising:

a current stage pixel, a previous stage pixel, and a before-previous stage pixel each comprising a liquid crystal layer;

a data line connected to the before-previous stage pixel, the previous stage pixel, and the current stage pixel to transfer data voltages;

a first gate line, a second gate line, and a third gate line connected to the before-previous stage pixel, the previous stage pixel, and the current stage pixel, respectively, so as to each transfer gate-on voltages;

a gate driver configured to apply the gate-on voltages to the first gate line, the second gate line, and the third gate line, respectively;

a data driver configured to apply the data voltages to the data line; and a signal controller configured to control operations of the gate driver and the data driver, wherein the gate-on voltage applied to the third gate line connected to the current stage pixel is configured to be applied during a main-charge period and a single one of a first pre-charge period and a second pre-charge period, the data voltages are configured to be applied, in order, to the before-previous stage pixel, the previous stage pixel, and the current stage pixel, and the signal controller is configured to control the gate driver to selectively apply the gate-on voltage to the third gate line connected to the current stage pixel during the single one of the first pre-charge period while the before-previous stage pixel is being charged and the second pre-charge period while the previous stage pixel is being charged, so as to at least partially pre-charge the current stage pixel.

2. The display device of claim 1, wherein:

in order to apply a first gray to the current stage pixel, the signal controller is further configured to control the gate driver to apply the gate-on voltage to the third gate line connected to the current stage pixel during the first pre-charge period, while a second gray is applied to the previous stage pixel.

3. The display device of claim 2, wherein:

the signal controller is further configured to control the gate driver to apply a gate-off voltage to the third gate line connected to the current stage pixel during the second pre-charge period.

4. The display device of claim 3, wherein:

the first gray is a maximum gray, and the second gray is a minimum gray.

5. The display device of claim 1, wherein:

in order to apply a first gray to the current stage pixel, the signal controller is further configured to control the gate driver to apply the gate-on voltage to the third gate line connected to the current stage pixel during the second pre-charge period, while the first gray is applied to the previous stage pixel.

6. The display device of claim 5, wherein:

the signal controller is further configured to control the gate driver to apply the gate-on voltage to the third gate line connected to the current stage pixel during the first pre-charge period, while a second gray is applied to the before-previous stage pixel.

7. The display device of claim 6, wherein:

the signal controller is further configured to control the gate driver to apply a gate-off voltage to the third gate line connected to the current stage pixel during the first pre-charge period, while the first gray is applied to the before-previous stage pixel.

8. The display device of claim 7, wherein:

the first gray is a maximum gray, and the second gray is a minimum gray.

9. The display device of claim 1, wherein:

in order to apply a second gray to the current stage pixel, the signal controller is further configured to control the gate driver so that the gate-on voltage is not applied to the third gate line connected to the current stage pixel during either the second pre-charge period or the first pre-charge period.

10. The display device of claim 9, wherein:

the signal controller is further configured to control the gate driver so that the gate-on voltage is not applied to the third gate line connected to the current stage pixel while the first gray is applied to either the before-previous stage pixel or the previous stage pixel, during either the second pre-charge period or the first pre-charge period.

11. The display device of claim 10, wherein:

the signal controller is further configured to control the gate driver to apply the gate-off voltage to the third gate line connected to the current stage pixel during the second pre-charge period and the first pre-charge period.

12. The display device of claim 11, wherein:

the first gray is a maximum gray, and the second gray is a minimum gray.

* * * * *